US012023780B2

(12) United States Patent
Weidner et al.

(10) Patent No.: US 12,023,780 B2
(45) Date of Patent: Jul. 2, 2024

(54) MANUFACTURING APPARATUS FOR PRODUCING A CURVED CONTOUR ON AT LEAST ONE END FACE OF A ROLL AND METHOD FOR PRODUCING A CURVED CONTOUR ON THE AT LEAST ONE END FACE WITH THE MANUFACTURING APPARATUS

(71) Applicant: Schaeffler Technologies AG & Co. KG, Herzogenaurach (DE)

(72) Inventors: Alexander Weidner, Fürth (DE); Horst Gredy, Oberreichenbach (DE); Stephan Woiwode, Erlangen (DE)

(73) Assignee: Schaeffler Technologies AG & CO. KG, Herzogenaurach (DE)

( * ) Notice: Subject to any disclaimer, the term of this patent is extended or adjusted under 35 U.S.C. 154(b) by 1127 days.

(21) Appl. No.: 16/648,084

(22) PCT Filed: Sep. 5, 2018

(86) PCT No.: PCT/DE2018/100754
§ 371 (c)(1),
(2) Date: Mar. 17, 2020

(87) PCT Pub. No.: WO2019/057238
PCT Pub. Date: Mar. 28, 2019

(65) Prior Publication Data

US 2020/0262021 A1 Aug. 20, 2020

(30) Foreign Application Priority Data

Sep. 21, 2017 (DE) ..... 10 2017 121 861.0

(51) Int. Cl.
*B24B 5/37* (2006.01)
*B24B 5/01* (2006.01)
(Continued)

(52) U.S. Cl.
CPC ..... *B24B 5/37* (2013.01); *B24B 5/01* (2013.01); *B24B 5/20* (2013.01); *B24B 5/225* (2013.01); *B24B 19/009* (2013.01)

(58) Field of Classification Search
CPC .... B24B 5/37; B24B 5/04; B24B 5/16; B24B 5/167; B24B 41/06; B24B 41/02;
(Continued)

(56) References Cited

U.S. PATENT DOCUMENTS 1,719,965 A 7/1929 Bruhl
2,908,119 A * 10/1959 Dudgeon ..... B24D 15/02 451/415

(Continued)

FOREIGN PATENT DOCUMENTS

CN 1067201 A 12/1992
CN 102753304 A 10/2012

(Continued)

*Primary Examiner* — Eric J Rosen
*Assistant Examiner* — Sharonda T Felton

(57) ABSTRACT

A manufacturing apparatus for producing a curved contour on an end face of a roll includes a grinding device and a holding device, linearly movable relative to the grinding device. The grinding device is for grinding the curved contour on the end face. The holding device is for holding the roll between the holding device and the grinding device. A method for producing the curved contour on the end face using the manufacturing apparatus is also disclosed. The method includes driving the holding device to move in a linear fashion relative to the grinding device.

12 Claims, 4 Drawing Sheets

(51) Int. Cl.
*B24B 5/20* (2006.01)
*B24B 5/22* (2006.01)
*B24B 19/00* (2006.01)

(58) Field of Classification Search
CPC ..... B24B 29/02; B24B 19/009; B24B 11/00; B24B 19/26; B24B 7/16; B24B 17/025; B24B 39/04; B24B 11/02; B23P 15/003; Y10S 451/913; B21H 1/12
See application file for complete search history.

(56) References Cited

U.S. PATENT DOCUMENTS

| | | | | |
|---|---|---|---|---|
| 3,910,275 | A | 10/1975 | Babey et al. | |
| 3,913,275 | A | 10/1975 | Brawley | |
| 3,988,861 | A | 11/1976 | Brawley | |
| 5,727,989 | A * | 3/1998 | Ohno | B24B 11/00 451/60 |
| 2014/0127980 | A1 * | 5/2014 | Chen | B24B 11/00 451/177 |

FOREIGN PATENT DOCUMENTS

| | | | |
|---|---|---|---|
| CN | 102753304 | B | 2/2015 |
| DE | 729885 | C | 1/1943 |
| DE | 19531965 | A1 | 3/1996 |
| EP | 1963693 | B1 | 9/2008 |
| GB | 2276213 | B2 | 9/1994 |
| JP | S53135436 | U | 10/1978 |
| JP | H02-76635 | A | 3/1990 |
| JP | H08-215783 | A | 8/1996 |
| WO | 2019057238 | A1 | 3/2019 |

* cited by examiner

MANUFACTURING APPARATUS FOR PRODUCING A CURVED CONTOUR ON AT LEAST ONE END FACE OF A ROLL AND METHOD FOR PRODUCING A CURVED CONTOUR ON THE AT LEAST ONE END FACE WITH THE MANUFACTURING APPARATUS

CROSS-REFERENCE TO RELATED APPLICATIONS

This application is the United States National Phase of PCT Appln. No. PCT/DE2018/100754 filed Sep. 5, 2018, which claims priority to German Application No. DE102017121861.0 filed Sep. 21, 2017, the entire disclosures of which are incorporated by reference herein.

TECHNICAL FIELD

The disclosure relates to a manufacturing apparatus for producing a curved contour on at least one end face of a roll. The disclosure also relates to a method for producing a curved contour on the at least one end face of the roll with the manufacturing apparatus.

BACKGROUND

Rolling elements with curved surfaces are sufficiently well known from the prior art. The curved surfaces are often ground with suitable apparatuses in order to provide them with a curved contour.

Document DE 19 531 965 A1, for example, describes a rolling element for roller bearings which has respective rounded regions at the boundaries between a rolling surface and two end surfaces of a roller. For this purpose, use is made of a grinding tool which comprises an outer grinding region for grinding the rolling surface, an end grinding region for grinding the end surface and a rounded grinding region for grinding the rounded region.

SUMMARY

The disclosure describes a manufacturing apparatus which is designed for producing a curved, in particular a crowned contour, on at least one end face of a roll. The roll is preferably designed as a rolling element for a rolling bearing. The roll is designed as a cylindrical roll, for example. However, it can also be a needle roller or a barrel roller. For example, the roll has a diameter of 5 millimeters, preferably of 6 millimeters, and/or of up to 8 millimeters. A length of the roll is preferably at least 4 millimeters, in particular at least 20 millimeters, more specifically at least 40 millimeters and/or a maximum of 70 millimeters.

The at least one end face is preferably arranged axially with respect to an axis of rotation of the roll. In particular, the roll has a lateral surface which extends radially around the axis of rotation of the roll. More specifically, the roll has a first and second end face, which are arranged axially with respect to the axis of rotation and opposite one another.

The manufacturing apparatus has a grinding device. The grinding device is designed to grind the curved contour on the at least one end face of the roll. For example, the grinding device is designed as a cuboidal jaw, in particular with a significantly greater length than height.

The manufacturing apparatus comprises a holding device. The holding device is designed to hold the roll between the holding device and the grinding device. For example, the holding device is designed as a further cuboidal jaw, the length of which is, in particular, greater than the height thereof. The grinding device and the holding device preferably have the same dimensions, in particular a same length and/or height. The grinding device and the holding device are preferably formed from a steel alloy.

According to the disclosure, the holding device can be moved in a linear fashion relative to the grinding device. The holding device can preferably be moved in the same orientation and/or parallel to the grinding device. In particular, the manufacturing apparatus comprises an actuator, e.g. a linear motor, for driving the holding device in a linear fashion relative to the grinding device. More specifically, the holding device is driven by the actuator to move in a linear fashion, in particular in the same orientation and/or parallel to the grinding device.

A preferred embodiment envisages that the grinding device is arranged in a fixed location. It is preferred if the grinding device is integrated as a grinding machine into a rolling machine and is anchored in a fixed location therein. In particular, the holding device is also integrated into the grinding machine and can be moved there in a linearly movable manner at a defined distance from the grinding device and in the same orientation as and/or parallel to the latter.

In a preferred embodiment, the roll can be arranged in positive engagement between the grinding device and the holding device. The roll is optionally arranged in a transition fit or press fit between the grinding device and the holding device. The grinding device and the holding device preferably make contact with the roll. In particular, the holding device has a holding surface, by means of which it holds the roll and presses it against the grinding device, ensuring that the roll cannot come away from the latter. It is particularly preferred if the holding surface is provided with a coating or a layer of material or surface structuring, e.g. knurling, which increases a friction coefficient of the holding surface. It is thereby possible to ensure reliable retention of the roll between the grinding device and the holding device. In particular, it is thereby possible to prevent the roll from slipping between the grinding device and the holding device, especially in and/or during the linear motion of the holding device.

A preferred design implementation of the grinding device envisages that the grinding device has a grinding channel with a channel opening. The grinding channel comprises an upper grinding profile and a lower grinding profile, for example. The upper and lower grinding profiles preferably extend along the channel opening and/or frame the latter along the grinding channel. The upper grinding profile is preferably designed for grinding the curved contour on the first end face of the roll. In particular, the lower grinding profile is designed for grinding the curved contour on the second end face of the roll. It is particularly preferred if the upper and lower grinding profiles have an abrasion-resistant coating, e.g. composed of boron nitrite (CBN), in order to avoid or delay wear in and/or during grinding. As an option, the grinding channel has a channel wall which is arranged opposite the channel opening.

A preferred embodiment envisages that at least a section of the roll can be arranged in the grinding channel. For this purpose, the manufacturing apparatus preferably comprises a feed device, which is designed to feed the roll to the grinding device, in particular into the grinding channel. As an option, the feed device places the roll in a channel entry, which forms an inlet to the grinding channel. The feed device can be a gripper of a robot arm, for example.

When the roll is arranged in the grinding channel, in particular in the channel entry, the axis of rotation of the roll preferably extends vertically, perpendicularly and/or normally between the two grinding profiles and/or in the same orientation as and/or parallel to the channel wall. In particular, the roll can be arranged in such a way in the grinding channel, in particular in the channel entry, that the first end face makes contact with the upper grinding profile of the grinding channel and/or that the second end face makes contact with the lower grinding profile of the grinding channel. In particular, the holding surface of the holding device rests against the lateral surface of the roll when the roll is arranged in the grinding channel, in particular in the channel entry. More specifically, the holding device thereby holds or presses the roll in the direction of the grinding channel and positions the end faces against the respective grinding profiles.

In a preferred embodiment, the roll can be driven by the linear motion of the holding device relative to the grinding device to roll on the grinding device and to pass through the grinding channel in a pass direction. By means of its linear motion, the holding device preferably drives the roll arranged in the grinding channel to move along the grinding channel in rotation about its axis of rotation. In particular, the roll passes through the grinding channel from the channel entry to a channel end, at which the fully machined roll is preferably ejected. The contact of the end faces with the respective grinding profile ensures the grinding of the curved contour of the first and second end faces in and/or during the rotation of the roll and the traversing of the grinding channel.

It is preferred if the upper grinding profile and the lower grinding profile are arranged obliquely, at an angle and/or on a radius or radius contour with respect to the channel wall. As a result, the curved contour on the at least one end face of the roll, in particular on the first end face, can be produced by the upper grinding profile, and that on the second end face can be produced by the lower grinding profile, in and/or during the traversing of the grinding channel. As an option, a special surface topography which can be produced by the manufacturing apparatus according to the disclosure and/or by the method according to the disclosure is formed on the fully machined roll.

In a preferred embodiment, the grinding channel is of tapered design in the pass direction of the roll. The grinding channel preferably narrows in the pass direction. In particular, the channel entry has a greater width than the channel end. Since the grinding of the at least one end face in and/or during the passage of the roll through the grinding channel results in axial length adaptation of the roll, the tapering and/or increasing narrowing of the grinding channel is preferred in order to ensure contact between the at least one end face and the corresponding grinding profile of the grinding channel.

By means of the manufacturing apparatus, effective and low-cost production, in particular mass production, of curved end faces on rolls can be provided. In particular, it is possible to increase a production rate of fully machined rolls as compared with conventional manufacturing apparatuses.

The disclosure furthermore relates to a method for producing a curved contour on at least one end face of a roll with the manufacturing apparatus in accordance with the above description. In the context of the method, the holding device is, in particular, driven by the actuator to move in a linear fashion relative to the grinding device.

In a preferred method step, the roll is arranged in the grinding channel, such that the lateral surface rests against the holding device, such that the first end face makes contact with the upper grinding profile and such that the second end face makes contact with the lower grinding profile. The roll is preferably driven relative to the grinding device by a linear motion of the holding device to pass through the first and second grinding channels, in particular in rotation.

In another preferred method step, the curved contour on the first end face is ground by the upper grinding profile and the curved contour on the second end face is ground by the lower grinding profile while the roll is passing in rotation through the grinding channel.

BRIEF DESCRIPTION OF THE DRAWINGS

Further features, advantages and effects of the disclosure will become apparent from the following description of preferred illustrative embodiments. In the drawings.

In the figures, corresponding or identical parts are in each case provided with the same reference signs.

DETAILED DESCRIPTION

Figure 1:
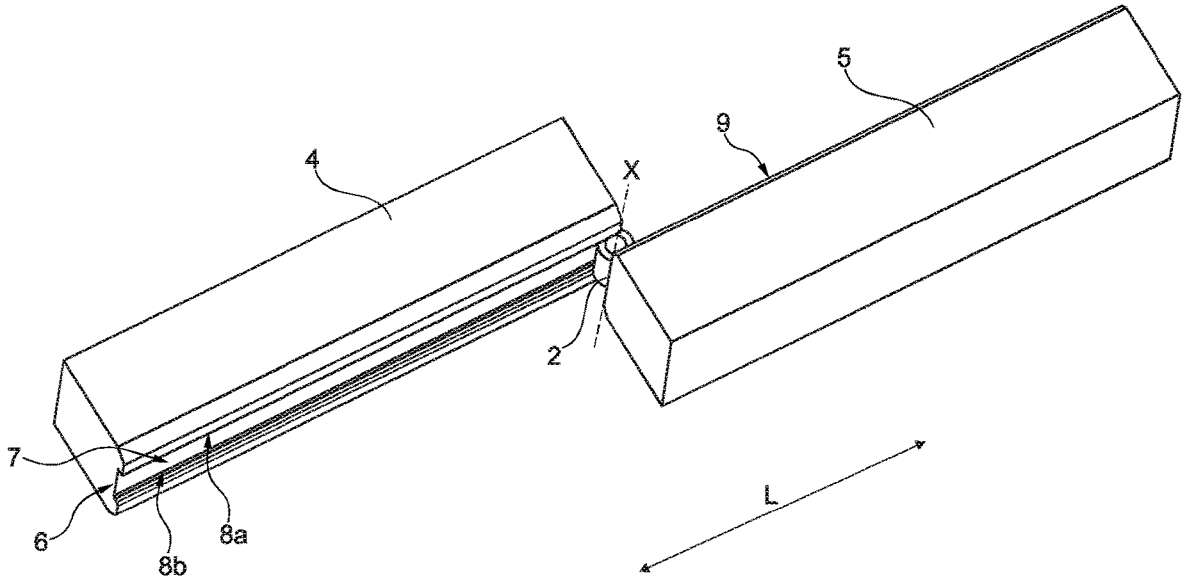
FIG. 1 shows a manufacturing apparatus for producing a curved contour on at least one end face of a roll with a grinding device and with a holding device.

FIG. 1 shows a manufacturing apparatus 1, which is designed for the production, preferably for the cost-effective mass production, of a curved contour on at least one end face 3*a*, 3*b* of a roll 2. The manufacturing apparatus 1 comprises a grinding device 4 and a holding device 5. The roll 2 is arranged between the grinding device 4 and the holding device 5, in particular held in positive engagement between them, in particular clamped.

The roll 2 is designed as a rolling element, in particular as a cylindrical roller, as a needle roller or barrel roller, for a rolling bearing. It has a diameter of, for example, 5 millimeters, preferably of 6 millimeters, and/or of up to 8 millimeters. A length of the roll 2 is preferably at least 4 millimeters, in particular at least 20 millimeters, more specifically at least 40 millimeters and/or a maximum of 70 millimeters.

Figure 3:
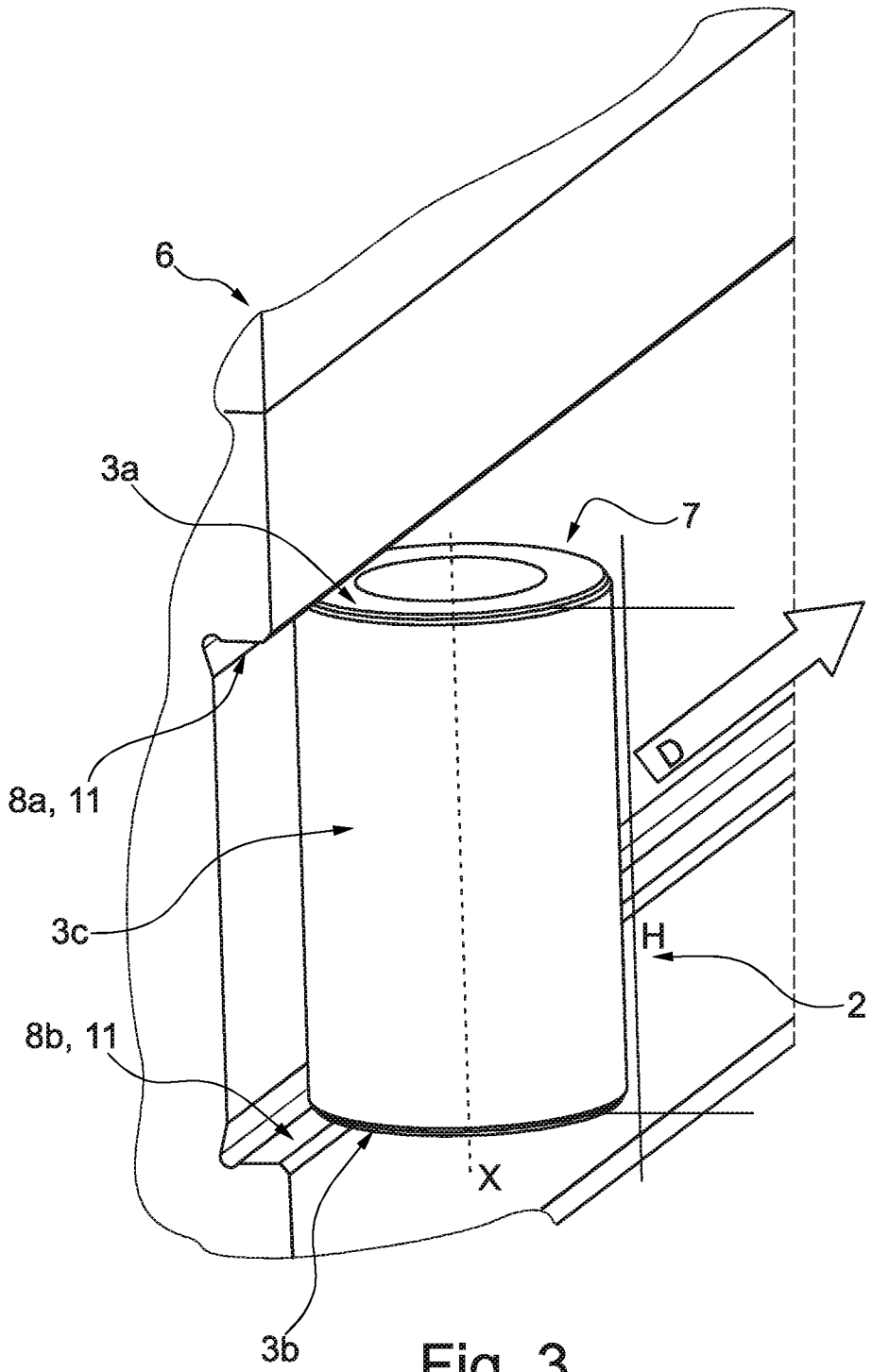
FIG. 3 shows the grinding channel from FIG. 2, wherein the roll is arranged in the grinding channel.

As shown more precisely in FIG. 3, the roll 2 has a lateral surface 3*c*, which is arranged radially with respect to the axis of rotation X of the roll 2. The roll 2 comprises a first and a second end face 3*a*, 3*b*, which are arranged axially opposite one another.

As shown in FIG. 1, the grinding device 4 and the holding device 5 of the manufacturing apparatus 1 are designed as cuboidal steel jaws. They can be integrated as a grinding machine into a rolling machine. It is also possible to use some other machine tool. The grinding device 4 is fixed in a fixed location and immovably in the grinding machine. The holding device 5 can be moved in a linear fashion relative to the grinding device 4. For this purpose, the manufacturing apparatus 1 comprises an actuator (not shown), e.g. a linear motor, which can move the holding device 5 in a linear fashion.

In a linear motion L of the holding device 5, it moves at a distance from the grinding device 4 and in the same orientation as and/or parallel to the grinding device 4.

The grinding device 4 has a grinding channel 6, which comprises a channel opening, a channel wall 7, an upper grinding profile 8*a* and a lower grinding profile 8*b*. The upper and lower grinding profiles 8*a*, 8*b* extend along the channel opening, which lies opposite the channel wall 7. The upper grinding profile 8*a* is designed to grind the first end face 3*a* of the roll 2, thus giving rise on said end face to the curved, in particular crowned, contour. The lower grinding profile 8*b* is designed to grind the second end face 3*b* of the roll 2, thus in this case too giving rise on said end face to the curved, in particular crowned, contour.

The holding device 5 has a holding surface 9 for holding the roll 2 in the grinding channel 6. The holding surface 9 is optionally provided with a coating which increases the friction coefficient, thus ensuring reliable retention of the roll 2 between the grinding device 4 and the holding device 5 and enabling slipping of the roll 2 to be avoided.

Figure 2:
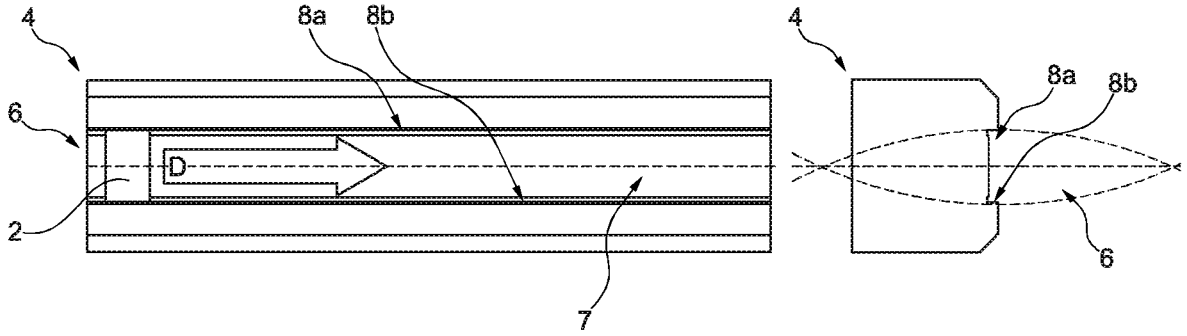
FIG. 2 shows a plan view and side view of a grinding channel, which is inserted into the grinding device.

FIG. 2 shows a plan view and a side view of the grinding channel 6 of the grinding device 4. FIG. 3 shows a detailed illustration of the roll 2, a section of which is arranged in the grinding channel 6.

The roll 2 is arranged partially in the grinding channel 6 in such a way that the axis of rotation X is perpendicular, normal or vertical and extends in the same orientation as the channel wall 7. By means of the two end faces 3*a*, 3*b*, the roll 2 makes contact with the grinding profiles 8*a*, 8*b*. By means of the holding device 5 shown in FIG. 1, the roll 2 is held in this position, in particular pressed into the grinding channel 2.

Activated by the actuator, the holding device 5 performs the linear motion L. The roll 2 is thereby set in rotation about the axis of rotation X in a pass direction D, with the result that the roll 2 moves through the grinding channel 6 in the pass direction D. In this case or during this process, the curved contour is ground on the first end face 3*a* of the roll 2 by the upper grinding profile 8*a*, and the curved contour is ground on the second end face 3*b* by the lower grinding profile 8*b*.

Figure 4:
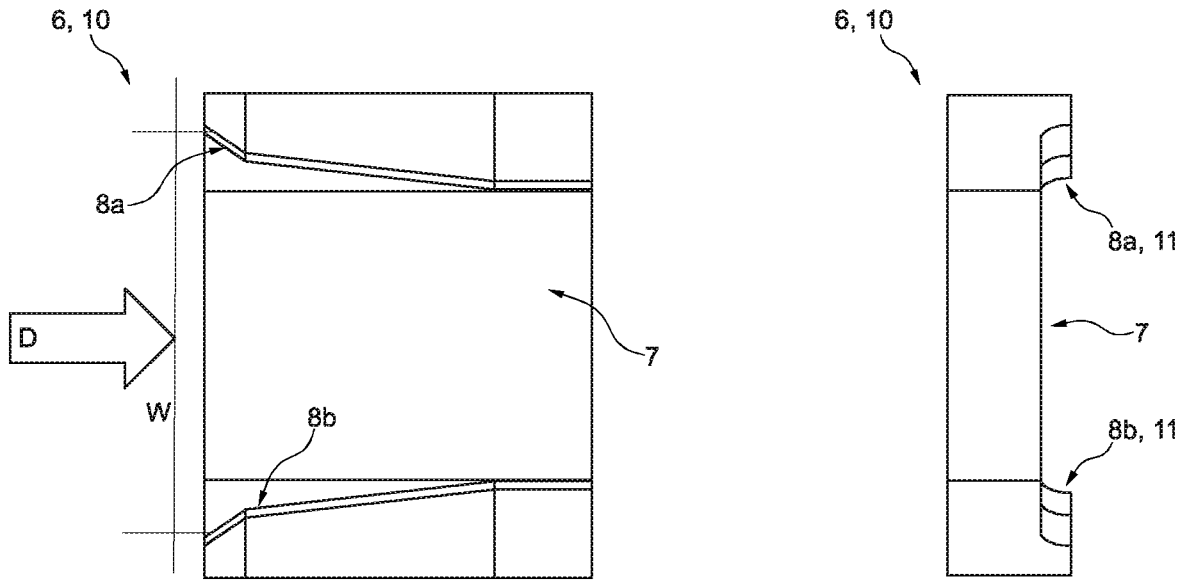
FIG. 4 shows a plan view of a channel entry of the grinding channel and a side view of the channel entry.

FIG. 4 shows a plan view of a channel entry 10 of the grinding channel 6 and a side view of the channel entry 10. The roll 2 is inserted into the grinding channel 6 through the channel entry 10, thus enabling the end faces 3*a*, 3*b* then to be provided with the curved contours by means of the rotary motion in the pass direction D. For insertion of the roll 2 into the grinding channel 6, the manufacturing apparatus 1 (FIG. 1) has a feed device (not shown), which is designed as a robot arm and/or a gripper, for example. After the complete traversal of the grinding channel 6, the roll 2 is ejected at a channel end 12 and is carried away by a conveyor belt, for example.

The channel entry 10 has a greater width W than the grinding channel 6 further along in the pass direction D. In particular, the grinding channel 6 tapers or narrows in the pass direction D. This is necessary since the roll 2 has a greater height H in the axial direction upon insertion into the channel entry 10 and before grinding than during or after grinding in the grinding channel 6. In particular, the height H (FIG. 3) of the roll 2 decreases in and/or during the grinding of the curved contour on the end faces 3*a*, 3*b*, and therefore the grinding channel 6 is adapted thereto by means of the taper and/or narrowing.

The upper and lower grinding profiles 8*a*, 8*b* are provided with an abrasion-resistant coating, e.g. composed of boron nitrite (CBN), thus enabling the service life to be increased and blunting to be delayed. The grinding profiles 8*a*, 8*b* extend transversely, at an angle or on a radius or radius contour with respect to the channel wall 7 (see also FIG. 3). In particular, the grinding profiles 8*a*, 8*b* are formed by a step and/or a radius or radius contour 11, which is/are configured in such a way that the curved contour of the end faces 3*a*, 3*b* can be ground.

By means of the manufacturing apparatus 1 shown in FIG. 1, it is possible to increase a production rate as compared with conventional manufacturing apparatuses for grinding curved end faces on rolling elements. It is thereby possible to produce the rolls 2 with the curved end faces 3*a*, 3*b* in a cost-effective manner.

REFERENCE NUMERALS

1 manufacturing apparatus
2 roll
3*a* first end face
3*b* second end face
3*c* lateral surface
4 grinding device
5 holding device
6 grinding channel
7 channel wall
8*a* upper grinding profile
8*b* lower grinding profile
9 holding surface
10 channel entry
11 step and/or radius
D pass direction
H height
L linear motion
W width
X axis of rotation

The invention claimed is:

1. A manufacturing apparatus for producing a curved contour on an end face of a roll, wherein the roll has a lateral surface extending radially around an axis of rotation of the roll, the manufacturing apparatus comprising:

a grinding device for grinding the curved contour on the end face; and a holding device, linearly movable relative to the grinding device, for holding the roll between the holding device and the grinding device;

wherein the grinding device includes a grinding channel and a channel wall, the grinding channel including an upper grinding profile configured to produce a first curved contour on the end face of the roll and a lower grinding profile configured to produce a second curved contour on a further end face of the roll;

wherein the channel wall extends from the upper grinding profile to the lower grinding profile;

wherein the grinding device is designed such that the axis of rotation of the roll extends parallel to the channel wall;

wherein the roll can be driven by a linear motion of the holding device relative to the grinding device to roll on the grinding device and to pass through the grinding channel in a pass direction; and wherein the pass direction is orthogonal to the axis of rotation.

2. The manufacturing apparatus of claim 1, wherein the grinding device is arranged in a fixed location.

3. The manufacturing apparatus of claim 1, wherein the roll can be arranged in positive engagement between the grinding device and the holding device.

4. The manufacturing apparatus of claim 1 further comprising; the roll arranged in positive engagement between the grinding device and the holding device.

5. The manufacturing apparatus of claim 1, wherein the roll can be arranged in the grinding channel such that the lateral surface of the roll rests against the holding device;

the end face contacts the upper grinding profile; and the further end face contacts the lower grinding profile.

6. The manufacturing apparatus of claim 1, wherein the grinding channel is tapered in the pass direction; or narrows in the pass direction.

7. A method for producing a curved contour on an end face of a roll using the manufacturing apparatus of claim 1, comprising driving the holding device to move in a linear fashion relative to the grinding device.

8. A method for producing a curved contour on an end face of a roll using the manufacturing apparatus of claim 1, comprising driving the holding device to move in a linear fashion relative to the grinding device.

9. The method of claim 8, wherein the roll is arranged in the grinding channel such that:

the end face contacts the upper grinding profile;

the further end face contacts the lower grinding profile; and the holding device rests against or presses against the lateral surface and the roll is set in rotation by the linear motion of the holding device and passes through the grinding channel in the pass direction.

10. The method of claim 9, wherein the first curved contour is ground by the upper grinding profile, and the second curved contour is ground by the lower grinding profile while the roll is passing in rotation through the grinding channel.

11. The manufacturing apparatus of claim 1, wherein the end face is spaced from the further end face along the axis of rotation.

12. The manufacturing apparatus of claim 11, wherein the lateral surface extends from the end face to the further end face.

* * * * *